US008111857B2

(12) United States Patent
Kuhtz et al.

(10) Patent No.: US 8,111,857 B2
(45) Date of Patent: Feb. 7, 2012

(54) IN-EAR HEADSET AND IN-EAR EARPHONE

(75) Inventors: Jan Peter Kuhtz, Celle (DE); Stefan Marten, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 927 days.

(21) Appl. No.: 11/992,026

(22) PCT Filed: Sep. 16, 2006

(86) PCT No.: PCT/EP2006/009031

§ 371 (c)(1),
(2), (4) Date: May 21, 2008

(87) PCT Pub. No.: WO2007/031340

PCT Pub. Date: Mar. 22, 2007

(65) Prior Publication Data

US 2008/0226113 A1 Sep. 18, 2008

(51) Int. Cl.
*H04R 25/00* (2006.01)

(52) U.S. Cl. ..... 381/372; 381/370; 381/373; 381/375

(58) Field of Classification Search ..... 381/312, 381/322, 370–373, 375

See application file for complete search history.

(56) References Cited

U.S. PATENT DOCUMENTS

| | | | | |
|---|---|---|---|---|
| 4,441,576 | A | 4/1984 | Allen | |
| 4,646,872 | A | 3/1987 | Kamon et al. | |
| 4,922,542 | A | 5/1990 | Sapiejewski | |
| 6,738,487 | B1 * | 5/2004 | Nageno et al. | 381/322 |

FOREIGN PATENT DOCUMENTS

| | | |
|---|---|---|
| DE | 10 2004 056 053 | 7/2005 |
| DE | 20 2005 007 074 | 8/2005 |
| EP | 1 058 479 | 12/2000 |
| WO | 94/10818 | 5/1994 |
| WO | 03/073790 | 9/2003 |

* cited by examiner

*Primary Examiner* — Ramon Barrera
(74) *Attorney, Agent, or Firm* — Frommer Lawrence & Haug LLP

(57) ABSTRACT

The invention relates to a headset comprising at least one earphone and a headset microphone for registering voice signals of the headset wearer. The headset microphone is fixed to one of the earphones. The earphone comprises at least one electroacoustic transducer, a rear volume, and a front volume which lies in front of the electroacoustic transducer. A first channel runs from the exterior through the earphone to the front volume. In addition, at least one acoustic filter and/or a microphone is arranged inside the first channel, in which a mechanical filter which protects against dirt and/or moisture is also disposed.

10 Claims, 1 Drawing Sheet

IN-EAR HEADSET AND IN-EAR EARPHONE

CROSS-REFERENCE TO RELATED APPLICATIONS

This is a national phase application of International Application No. PCT/EP2006/009031, filed Sep. 16, 2006 which claims priority of German Application No. 10 2005 044 495.4, filed Sep. 16, 2005, the complete disclosures of which are hereby incorporated by reference.

BACKGROUND OF THE INVENTION a) Field of the Invention

The present application relates to an in-ear headset and an in-ear earphone.

b) Description of the Related Art

Headsets typically have one or two earphones and a gooseneck microphone attached to one of the two earphones. The earphones may be embodied as encapsulated earphones, as on-ear earphones or as in-ear earphones.

The earphones have one or several electroacoustic transducers for reproducing audio signals. In addition to reproducing audio signals, the earphones are partly used to attenuate ambient noise passively.

U.S. Pat. No. 4,646,872, U.S. Pat. No. 4,441,576 and U.S. Pat. No. 4,922,542 represent general prior art.

A headset which has one or two earphones with a custom-made otoplastic and a gooseneck microphone is known from DE 10 2004 056 053 A1. The custom-made otoplastic is placed on a user's ear. A gooseneck microphone for registering audio signals is attached to one of the earphones. At least one acoustic channel for receiving an acoustic filter is provided in the otoplastic. Alternatively, at least one channel may be provided in the earphone for receiving at least one acoustic filter. An ear protection unit is also shown, which has standard ear plugs with a channel running through the ear protection unit, wherein an acoustic filter with attenuation characteristics dependent on noise level is disposed in the channel.

However, such headsets or such ear protection units are not suitable for all areas of application, particularly when there is exposure to changing weather conditions.

OBJECT AND SUMMARY OF THE INVENTION

The primary object of the present invention is to provide a headset and an in-ear earphone which may be used even under changing weather conditions.

This object is achieved in accordance with the present invention by a headset comprising at least one earphone and a headset microphone for registering voice signals of the headset wearer. The headset microphone is fixed to one of the earphones. The earphone has at least one electroacoustic transducer, a rear volume, and a front volume which lies in front of the electroacoustic transducer. A first channel runs from the exterior through the earphone to the front volume. At least one first acoustic filter and/or a microphone is disposed in the channel. A first mechanical filter is provided for protecting against dirt and/or moisture is disposed in the first channel.

The object is also achieved by an in-ear earphone which comprises an electroacoustic transducer, a rear volume, and a front volume which lies in front of the electroacoustic transducer. A first channel is included which runs from the exterior through the earphone to the front volume. The earphone further comprises at least one acoustic filter disposed in the first channel and a mechanical filter disposed in the first channel for protecting against dirt and/or moisture.

A headset comprising at least one earphone and a headset microphone is thus provided, said microphone being attached to one of the earphones. The earphone comprises at least one electroacoustic transducer, a rear volume, and a front volume which lies in front of the electroacoustic transducer. At least one first channel runs from the exterior through the earphone to the front volume, wherein an acoustic filter is disposed in the first channel. In addition, a mechanical filter for protecting against dirt and moisture is disposed in the first channel.

Due to mechanical closure of the channel, dirt is unable to enter via the acoustic channel extending from the outside to the inside.

Due to the mechanical filter being disposed in the channel, the filter is provided without a coupling to a rear volume of the earphone. The filter is thus disposed in a bypass.

According to one aspect of the present invention, the mechanical filter is configured such that it mechanically seals the channel without affecting the acoustic characteristics of the channel. Mechanical closure without acoustic impairment is therefore assured. The filter, which in many cases is mechanically sensitive, can also be protected against dirt and moisture.

According to another aspect of the present invention, the mechanical filter is configured as a fine-meshed gauze, as a diaphragm, and/or as a hydrophobic unit.

According to another aspect of the present invention, the mechanical filter is configured to be replaceable. This means that dirty or contaminated mechanical filters can be easily replaced.

According to another aspect of the present invention, the earphone has a rear encapsulated volume which is separated from the channel.

According to another aspect of the present invention, the channel is connected to the volume which lies in front of the transducer.

According to yet another aspect of the present invention, at least one microphone for active noise compensation is disposed inside the earphone.

According to another aspect of the present invention, the headset has a unit for receiving ear tips, wherein said unit has a channel passing through it, in which a mechanical filter for protection against dirt is disposed.

The embodiments of the invention shall now be described with reference to the attached drawing:

DESCRIPTION OF THE PREFERRED EMBODIMENTS

Figure 1:
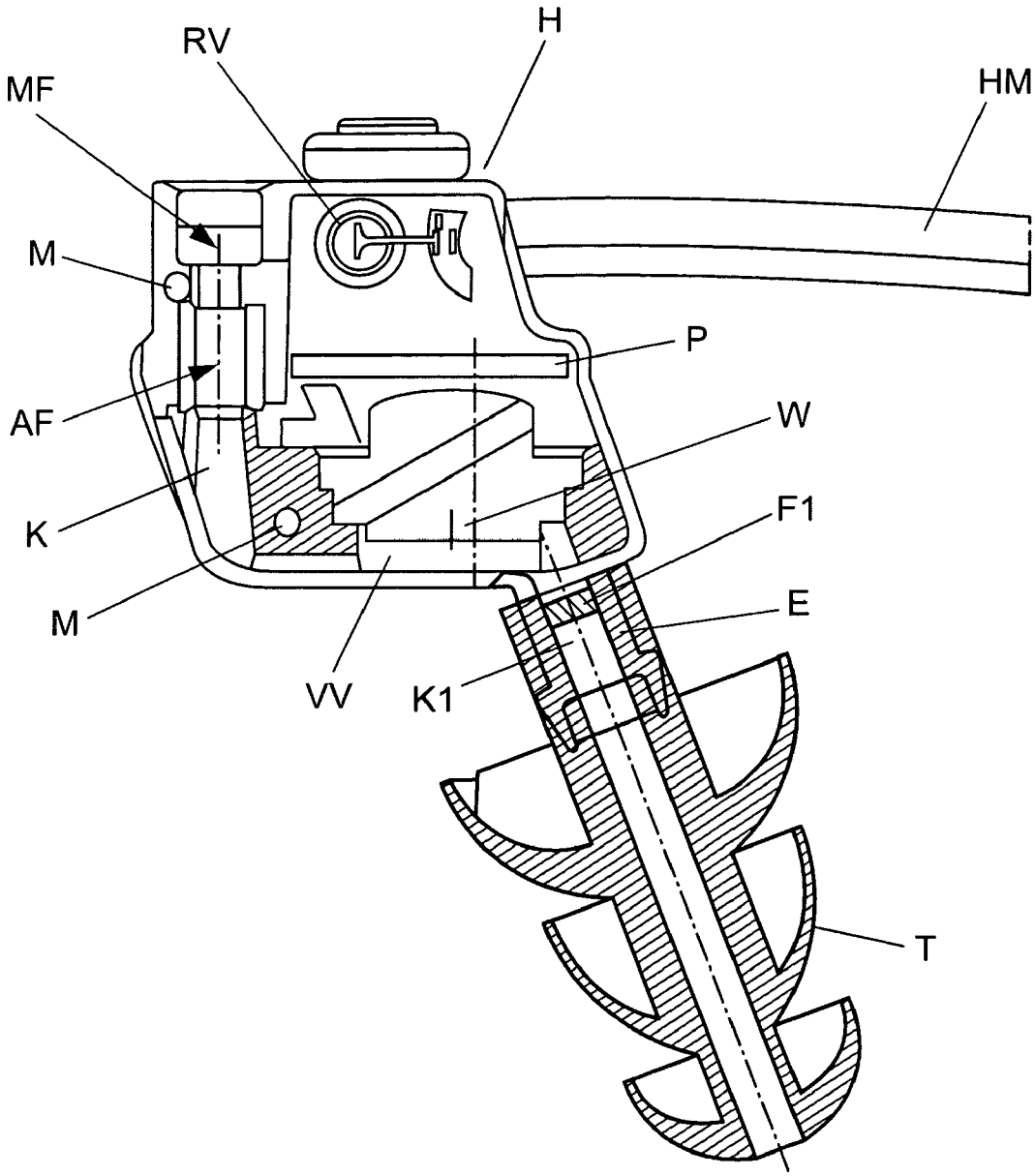
FIG. 1 shows a schematic cross-section through a headset according to one embodiment of the invention.

FIG. 1 shows a cross-section through a headset according to a first embodiment of the invention. In FIG. 1, an earphone H with a headset microphone HM attached thereto is shown. The earphone has at least one electroacoustic transducer W, with a rear encapsulated volume RV and a front volume VV which lies in front of the transducer. A circuit board P for accommodating the electronics for the earphone is provided in rear volume RV. The electronics may include an audio amplifier. A first channel or bypass K is also provided, which leads from the exterior to the front volume VV in front of transducer W. At least one acoustic filter AF is disposed in channel K. A mechanical filter MF closes first channel K. The earphone may also have at least one microphone M. Microphone M may be disposed in or at first channel K. Alternatively, or additionally, microphone M may be disposed in a region between the channel or bypass K and transducer W. Said microphone may be used in combination with an active noise compensation unit for active noise compensation. The electronics for active noise compensation may likewise be disposed on circuit board P in rear volume RV.

According to a second embodiment, an in-ear earphone is provided which corresponds substantially to the earphone in FIG. 1, but in which no headset microphone HM is attached to the earphone.

Such a headset or in-ear headset and such an in-ear earphone can be produced in large numbers because a custom-made otoplastic is not necessarily required. By means of mechanical filter MF, the headset and the in-ear earphone can also be used where dirt and moisture are present. Due to the configuration of the encapsulated rear earphone volume RV, and the acoustic channel or bypass K, spatial separation of the earphone volume and first channel K is permitted, such that acoustic and electrical functional areas (i.e. circuit board P with corresponding electronics) are spatially separated from each other. Simple replacement of the mechanical filter means that cleaning is simple to carry out.

Mechanical filter (MF) is preferably provided as a fine-meshed gauze, as a diaphragm, or as some other hydrophobic unit. The hydrophobic device allows waterproofness to be achieved without affecting the acoustic characteristics of the channel. Due to the separation of the acoustic bypass or channel and the electronic devices (circuit board P), the electronics are protected against entry of water and dirt.

Rear earphone volume RV is fully encapsulated. However, because the first acoustic channel K is provided, the front volume VV in front of transducer W can be connected rearwards or externally with the surroundings. All surfaces which can come into contact with the ear are preferably smooth in order to ensure simple cleaning.

Due to the arrangement of microphones M inside the housing of the earphone, the microphones are protected against external influences but can nevertheless register the audio signals required for active noise compensation. The electronics for active noise compensation may be disposed on circuit board P in rear volume RV, for example. Alternatively, the electronics may be disposed on the outside of the earphone, or in a separate housing on a cable of the headset or the in-ear earphone.

The mechanical filters or protective filters described above may be mass-produced products used in the hearing aid industry, so they can be produced inexpensively.

As an alternative to a replaceable mechanical filter MF, the mechanical filter may be configured as a permanent diaphragm fixture. It should be ensured that the diaphragm can be cleaned in a simple manner.

The earphone may also have a ear plug (not shown), by means of which the first channel or bypass can be mechanically and/or acoustically sealed from the exterior. This ear plug is designed to be removable, so that a user is able to remove or insert the ear plug by himself. Additional protection against an elevated ambient noise level is thus provided.

In addition, a unit E which projects outwards and which has a second channel K1 is provided. Unit E is used to accommodate ear tip T. Unit E has a channel K1 passing through it, in which an additional filter F, preferably a mechanical filter, may be disposed. This second mechanical filter F is used to protect against dirt (e.g. ear wax) or moisture that can enter through channel K1. Ear tip T is preferably configured to be replaceable, so that the earphone can be adapted to different ear geometries. As an alternative to the ear tip, an otoplastic, in particular a custom-made otoplastic, can be attached to unit E so that the earphone sits better on a user's ear.

The microphone amplifier and any active noise compensation unit may be disposed on the circuit board. Circuit board P and the electronics disposed thereon may be placed inside at least one of the earphones.

If active noise compensation is to be provided, then a circuit board with the relevant electronics, should be provided in both earphones.

While the foregoing description and drawings represent the present invention, it will be obvious to those skilled in the art that various changes may be made therein without departing from the true spirit and scope of the present invention.

What is claimed is:

1. A headset comprising:

at least one earphone and a headset microphone for registering voice signals of the headset wearer;

said headset microphone being fixed to one of the earphones;

said earphone has at least one electroacoustic transducer, a rear volume, and a front volume which lies in front of the electroacoustic transducer;

a first channel running from the exterior through the earphone to the front volume;

at least one first acoustic filter and/or a microphone is disposed in the channel; and a first mechanical filter for protecting against dirt and/or moisture being disposed in the first channel.

2. The headset of claim 1;

wherein the mechanical filter is configured such that it mechanically seals the first channel without substantially affecting the acoustic characteristics of the first channel.

3. The headset of claim 1;

wherein the mechanical filter is configured as a fine-meshed gauze, as a diaphragm, and/or as a hydrophobic unit.

4. The headset of claim 1;

wherein the mechanical filter is configured to be replaceable.

5. The headset of claim 1;

wherein the rear volume is encapsulated and separated from the channel.

6. The headset of claim 1;

wherein at least one microphone and one active noise compensation unit are disposed in the earphone.

7. The headset of claim 1;

wherein a circuit board is disposed in the rear volume.

8. The headset of claim 1, further comprising:

a mechanical closure for sealing the first channel from the exterior;

wherein the mechanical closure seals the first channel acoustically.

9. The headset of claim 1, further comprising:

a unit which projects outwards for receiving an ear tip, wherein said unit has a second channel and wherein a mechanical filter is disposed in the second channel in order to protect against dirt.

10. An in-ear earphone comprising:

an electroacoustic transducer, a rear volume, and a front volume which lies in front of the electroacoustic transducer;

a first channel which runs from the exterior through the earphone to the front volume;

at least one acoustic filter disposed in the first channel; and a mechanical filter disposed in the first channel, for protecting against dirt and/or moisture, the mechanical filter being separate from the acoustic filter.

* * * * *